US005342039A

United States Patent [19]

Carlotta et al.

[11] Patent Number: 5,342,039

[45] Date of Patent: Aug. 30, 1994

[54] SHEET HANDLING DEVICE AND METHOD FOR TRANSPORTING SHEETS

[75] Inventors: Michael Carlotta, Sodus; David G. Anderson, Ontario, both of N.Y.

[73] Assignee: Xerox Corporation, Stamford, Conn.

[21] Appl. No.: 992,199

[22] Filed: Dec. 17, 1992

[51] Int. Cl.[5] ..... B65H 9/00

[52] U.S. Cl. ..... 271/236; 271/245; 271/250; 271/267

[58] Field of Search ..... 271/10, 42, 236, 245, 271/247, 250, 267, 84; 221/210, 259, 260

[56] References Cited

U.S. PATENT DOCUMENTS

| | | | |
|---|---|---|---|
| 1,263,669 | 4/1918 | Hoberg | 221/259 |
| 1,299,920 | 4/1919 | Droitcour | 271/236 |
| 1,883,471 | 10/1932 | Barrett | 271/245 |
| 3,970,299 | 7/1976 | Berger et al. | 271/236 |
| 4,330,117 | 5/1982 | Weisback | 271/245 |
| 4,360,196 | 11/1982 | Weisback | 271/245 |
| 4,425,867 | 1/1984 | Tobias | 271/267 |
| 4,568,075 | 2/1986 | Bothner | 271/245 |
| 4,591,143 | 5/1986 | Jeschke | 271/236 |
| 4,848,762 | 7/1989 | Beery | 271/19 |
| 4,920,421 | 4/1990 | Stemmle | 358/296 |
| 5,062,602 | 11/1991 | Kress et al. | 271/104 |

FOREIGN PATENT DOCUMENTS

0399970A1 11/1990 European Pat. Off. .

*Primary Examiner*—H. Grant Skaggs

[57] ABSTRACT

A sheet transport for transporting sheets across a surface which includes an elongated member supported for transverse movement across the surface. The transport further includes a fibrous material which comprises a base substrate portion carried by the member and a plurality of fibers extending from the base substrate so that the extending fibers form a sheet engaging area with the surface. Apparatus for moving the member across the surface is also provided so that a sheet in the sheet engaging area is translated in a process direction across the surface when the member is translated.

1 Claim, 5 Drawing Sheets

SHEET HANDLING DEVICE AND METHOD FOR TRANSPORTING SHEETS

The present invention relates to a sheet handling device and more particularly to a sheet handling device for transporting sheets across a flat surface to a processing area.

U.S. patent application Ser. No. 07/991,923, filed concurrently herewith, assigned to the Xerox Corporation, entitled Method and Apparatus for Gripping and Registering Sheets is hereby cross-referenced and incorporated herein by reference thereto.

BACKGROUND OF THE INVENTION

Sheet handlers are well known and, generally, such sheet handlers have a defined path through which sheet material is transported to and from one or more process stations. In image input devices, electrophotographic devices, ink jet printing devices and other such devices, sheet handling devices are employed to sequentially transport sheet material (i.e., sheets of paper and paper-like substrates, such as mylar, vellum, and the like and hereinafter collectively referred to as sheets) to and from image processing stations, such as scanning devices, imaging devices, fusing stations, imprinting stations, and the like.

Sheet handlers of the type to which this invention relates include both sheet handlers which are known as document handlers for sequentially feeding individual documents from a document input station to a document image processing station and then to a document output station, as well as sheet handlers of the type for sequentially feeding individual copy sheets from a copy sheet input station, to a copy sheet imprinting, and to a copy output station. In general, in devices having a flat surface or a relatively flat surface upon which an image processing operation occurs a sheet handler is employed to transport the sheets across the surface. For example, in document handling devices having a imaging platen, in general, a roller, friction belt, or vacuum belt transport is employed to move a document across the surface.

These devices are functional, and they produce reasonably satisfactory results. However, they also tend to be somewhat expensive, not entirely simple, and not always entirely effective. Furthermore, with some or all of these devices, actuated registration means such as scuffer wheels, cross rollers and the like must be employed either concurrently with the drive mechanism or at an upstream portion of the path so that the transported sheets are registered at a processing station. Thus, there exists a need for a relatively simple, low cost apparatus for transporting documents and sheets in general across a flat surface to a process station in a registered manner.

The following disclosures may be relevant to various aspects of the present invention.

EP-A-90850156.2
Publication No. 0399970
Filed: April 24, 1990
Inventor: Fujino
U.S. Pat. No. 5,062,602
Patentee: Kress et al.
Issued: November 5, 1991
U.S. Pat. No. 4,920,421
Patentee: Stemmle
Issued: April 24, 1990

-continued

U.S. Pat. No. 4,848,762
Patentee: Beery
Issued: July 18, 1989

European Application No. 90850156.2, Publication No. 0399970 discloses an image scanning apparatus comprising a document feed mechanism which includes a light source and an image sensor reciprocally moved from a home position and a starting position. the document feeding mechanism is mechanically connected to the image sensing unit and moves with the sensing unit. The document feed mechanism includes a functional roller unit which contacts a glass platen, for positioning an image bearing surface face down, and which is coupled to a shaft through a one-way clutch. The clutch inhibits rotation of the roller during movement of the scanning unit and feed mechanism from the home position to the scan starting position and allows rotation during the reverse movement. An operator inserts a document in proper orientation between the frictional roller and the glass platen; the document is then fed or movement to the proper position by the movement of the scanning unit and the feed mechanism from the home position to the scanning position. The document is then scanned during the return movement of the feeder mechanism and scanning unit as the roller freely rotates on the document.

U.S. Pat. No. 5,062,602 discloses the use of a one-way fibrous cloth or pad material, which has fibers oriented toward the rear or upstream position of a feeder tray. The fibers engage the trailing or upstream edge of the sheet above the feed sheet as the feed sheet is fed from a bottom sheet feeder to functionally resist the downstream movement of the sheet above the feed sheet to reduce feeding of multiple sheets from the tray at one time U.S. Pat. No. 4,920,421 discloses a combined input and output scanner assembly including a copy sheet transport for transporting copy sheets through the assembly moving a scanning and printing assembly to enable the printing of the copy sheet.

U.S. Pat. No. 4,848,762 discloses a sheet feed apparatus for feeding a sheet from a stack of sheets. A plurality of sheet engaging pressure pads are employed to engage a sheet so that a sheet may be fed from planar and non-planar stacks.

The foregoing references failed to provide a relatively simple, sheet transport for transporting sheets across a flat surface to a processing station for processing.

In accordance with one aspect of the present invention, a sheet transport for transporting sheets across a surface comprises an elongated member, a multiplicity of fibers extending outwardly from the elongated members with the fibers forming a sheet receiving area with the surface, and means for moving said member across the surface so as to translate a sheet in the sheet receiving area across the surface. The invention can further include a base substrate for supporting the fibers and securing the fibers to the member. The invention may also include orienting the fibers in substantially the same direction extending in a transverse direction from the horizontal plane. The invention can further include a lateral registration member for laterally registering sheets translated across the surface. A lead edge registration member may be included within this aspect of the invention for engaging and registering the leading edge of sheets transported across the surface. The invention may also include clamping means for selectively and releasably securing sheets to the surface, and the clamping means can include the registering edge. The moving means in accordance with this aspect of the invention may also enable moving said member in a second direction transverse to the first mentioned direction away from said lead edge registration means so as to smooth and straighten a sheet secured by said clamping means.

In accordance with another aspect of the present invention, there is provided a method for transporting sheets across a surface to processing station. This method comprising the steps of providing a fibrous brush-like material so that the fibers contact a sheet on a relatively smooth surface, orienting the fibers of said brush-like material in substantially a first direction, and moving the material in the first direction to translate the sheet in contact with the fibers of the brush-like material. The method of this aspect of the invention may also include translating the sheet from a sheet receiving area to a processing station. Further steps also includable within this aspect of the invention are registering the sheet along an edge thereof substantially perpendicular to the first direction, as well as, translating the sheet in a second direction, transverse to the first direction, to laterally register the sheet along a lateral edge guide substantially parallel to the first direction so as to register the sheet along two adjacent edges.

In yet another aspect of the present invention, a sheet actuator for translating a sheet across a substantially flat surface is provided. This sheet actuator comprises an elongated fibrous material supported adjacent the flat surface so that the fibers of the material engage a sheet disposed on the surface. the sheet actuator further comprises means for moving the material relative to the surface so as to transport the sheet relative to the surface. This aspect of the invention can also include means for urging the sheet to a position between the surface and the material so that actuation of the moving means moves the sheet. In addition, this aspect of the invention can further include means for registering the sheet transported by said moving means. The sheet actuator of this aspect of the invention may also include means for securing the sheet to the surface at a predetermined position on the surface.

BRIEF DESCRIPTION OF THE DRAWINGS

Other features of the present invention will become apparent as the following description proceeds and upon reference to the drawings, in which.

Figure 1A:
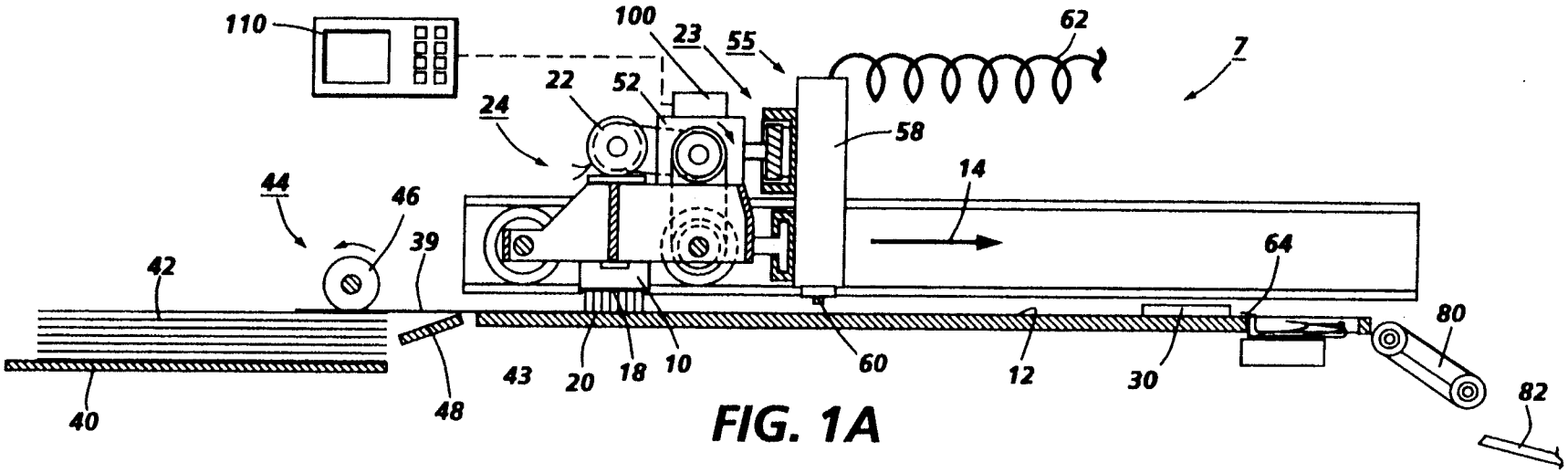
FIG. 1A and 1B are sectional, elevational views showing an illustrative image processing device having a sheet handling system incorporating the features of the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION

The sheet handling system of the present invention will now be discussed in conjunction with the illustrative image processing device 7 of FIGS. 1A and 1B. An elongated member 10 is supported for movement in the direction of arrows 14 and 16 (i.e., perpendicular to the longitudinal or central axis of the member 10) over a surface, which in this embodiment is generally known as a platen 12. Secured along the base of the member 10 is a brush-like material 18 which has fibers 20 extending therefrom. The material 18 is supported by the member 10 so that the fibers 20 and the platen 12 form a sheet engaging area therebetween.

Motive means, in this case a motor 22 and a drive assembly 23, are provided to move a carriage assembly 24, which supports the member 10 in a direction perpendicular to the central axis of the member 10 (i.e., parallel to the arrows 14 and 16). The fibers of the material 20 of the present embodiment are all oriented in substantially the same direction as arrow 14 and the forward movement of the member 10 and opposed to the reverse movement of the member in the direction of arrow 16.

It is preferred that the fibers, as indicated above, are only substantially oriented in the direction of arrow 14. That is, they are also oriented or biased from the direction of arrow 14 toward a lateral registration edge 30 from between 0° and 15° and preferably about 8°. The fibers also extend from the material 18 at a substantial angle between approximately 20° and 60° and preferably between 45° and 30° to the horizontal plane of the material 18.

Materials of the type useful herein are well known and often are referred to as "one-way" materials. Examples of materials useful herein include "Climber P" Nylon fabric, sold as a finished fabric by Collins & Aikman Corporation Industrial Fabrics, 1803 North Main Street, Roxboro, N.C., U.S.A., 27573, with an average pile tuft orientation angle from the horizontal or backing fabric plane of 25 to 55 degrees and a latex back coating, a trilobal filament shape, and a 37 filament count pile yarn. The fiber or pile therefore may be yarn type 6R70 of 520 Denier/37 filament Nylon supplied by Allied Fibers Inc. Suite 108 Friendship Central Park, Greensboro, N.C., U.S.A., 27409. Another material of this general type is 3M Company Brushlon TM Fiber Short Trim product No. 321B (titled fibers), or modifications thereof.

Figure 1B:
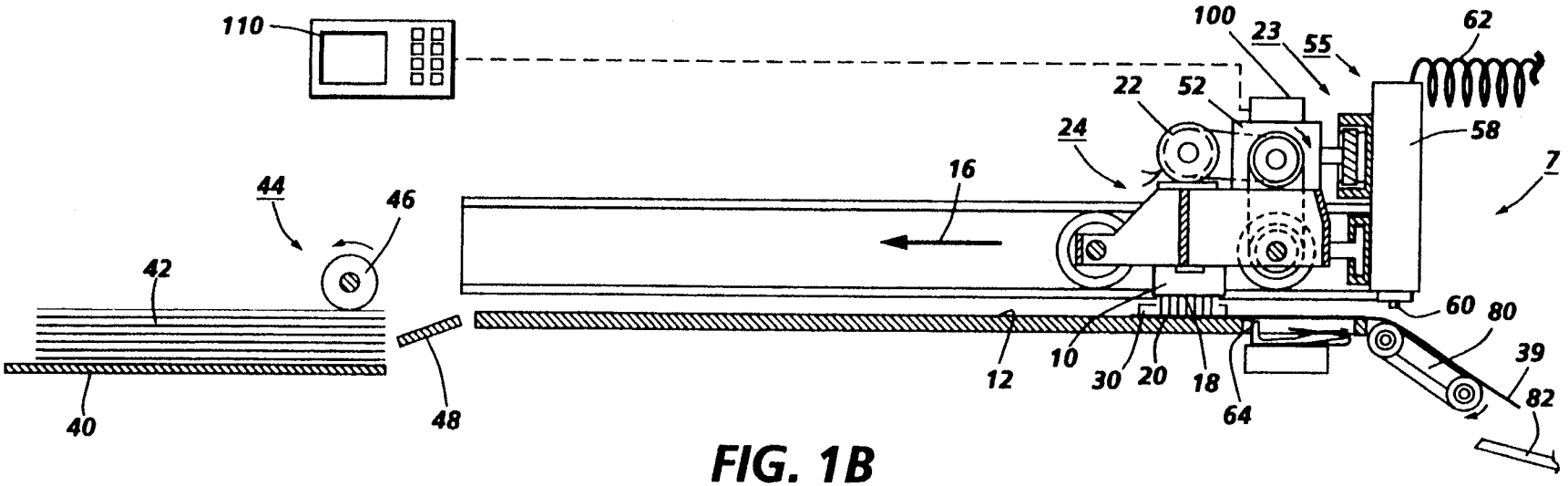

In the operation of the image processing device of FIGS. 1A and 1B, a sheet 39 is delivered from a sheet stacking tray 40 in which a stack of sheets 42 is disposed therein for feeding sheets individually to a sheet receiving area 43 between the fibers 20 and the platen 12 when the carriage assembly 24 has moved proximate to the limit of its travel in the direction indicated by arrow 16 (i.e., the position depicted in FIG. 1A). Sheets are fed from the tray 40 by sheet feeding means 44 which includes a retard feed roll device 46 and a sheet retard guide 48.

The member 10, as previously described, is secured for movement to the movable carriage assembly 24. The carriage assembly 24 supports the drive assembly 23, which includes a transmission 52 secured to the assembly 24 for translating imaging device means 55 perpendicular to the travel of the assembly 24, as well as translating the assembly 24. In this instance, the imaging device means 55 depicted is an ink jet printing head with a housing 58, a print nozzle 60 and an ink supply tube 62 interconnecting the nozzle with an ink supply reservoir (not shown). Thus, the nozzle 60 or a series of nozzles can scan a sheet through the action of drive assembly 23 and carriage assembly 24.

The operation of the transport means will now be more fully explained, as follows, the motor 22 drives the carriage assembly 24 from the sheet receiving position, shown in FIG. 1A, to the end of the track as depicted in FIG. 1B. A sheet 39 which is fed by the sheet feeding means 44 passes under the fibers 20 without substantial interference due to the orientation of the fibers so that a portion of the sheet extends beyond the sheet receiving area 43. The sheet is translated across the platen due to the frictional engagement of the sheet with the fibers 20, again due to the orientation of the fibers, as the carriage assembly 24 is driven in the direction of arrow 14.

When any portion of the leading edge of the sheet 39 engages a front registration edge 64, skewing of the sheet relative to the process direction is removed. The sheet 39 in such cases tends to rotate under the continued urging of the fibers 20 so as to register along the registration edge. It has been found that skewing of a sheet from angles ranging from about 10° to about 15° of skew from the centerline of a sheet to the process direction can be accomodated. Once the lead edge of the sheet is fully engaged along the registration edge, the sheet 39 ceases forward translation. As previously recited, the fibers 20 are at an angle to the direction of movement so that, as the carriage assembly 24 and, thus, the fibers 20 continue to move in the direction of arrow 14, the lateral forces on the sheet from the frictional engagement with the fibers are sufficient to urge the sheet in a side or lateral direction toward the lateral registration edge 30.

To summarize this, Applicants have found that, by orienting a piece of "one-way" fabric so that the fibers extend from the material to form a sheet engaging area with a surface and are also oriented so that the fibers are also substantially directed in a forward or process direction with the slight angular bias previously mentioned, a sheet in the engaging area may be transported in the first direction by the movement of the fabric in the first direction to a process registration edge. After the sheet has registered against the process registration edge, the continued movement of the material in the process direction tends to urge the sheet laterally along the process direction registration edge. Thus, by orienting the fibers 20 at the aforementioned slight angle to the perpendicular direction of the front registration edge 64 and toward the side or lateral registration edge 30, the sheet 39 is urged toward the lateral registration edge 30 after engagement with the front registration edge 64.

Transport belt 80 and sheet support tray 82 are also provided for sheets exiting the platen as shown in FIG. 1B. In this case, the carriage assembly 24, after returning in the direction of arrow 16 over the sheet, is again moved in the direction of arrow 14 to drive the sheet over the front registration edge 64, which has been withdrawn from the path, as described below, and to the transport belt 80.

In the embodiment of FIGS. 1A and 1B, the control signals for the image processing device 7 are provided by the machine controller 100. The controller 100 preferably comprises a known programmable microprocessor system, as exemplified by extensive prior art. Plural but interconnecting microprocessors may be used include at different locations of the image processing device 7 and devices associated therewith. It is contemplated that the controller 100 controls all of the machine steps and functions described herein. The controller 100 also conventionally provides other selections by the operator through a connecting panel 110 of control switches.

Figure 2:
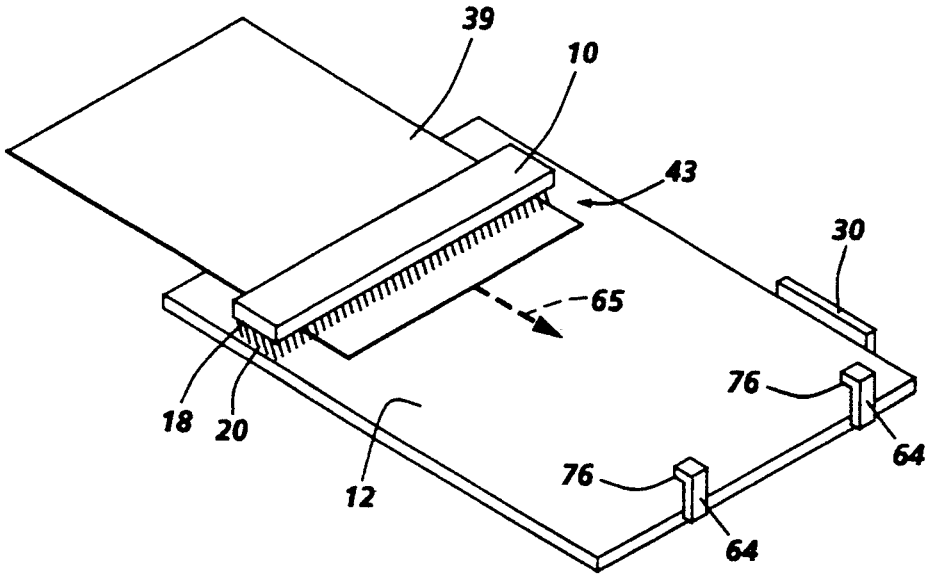
FIG. 2,3,4,5, and 6 are perspective schematic views of a sheet handling system according to the present invention to illustrate the operation thereof.
Figure 3:
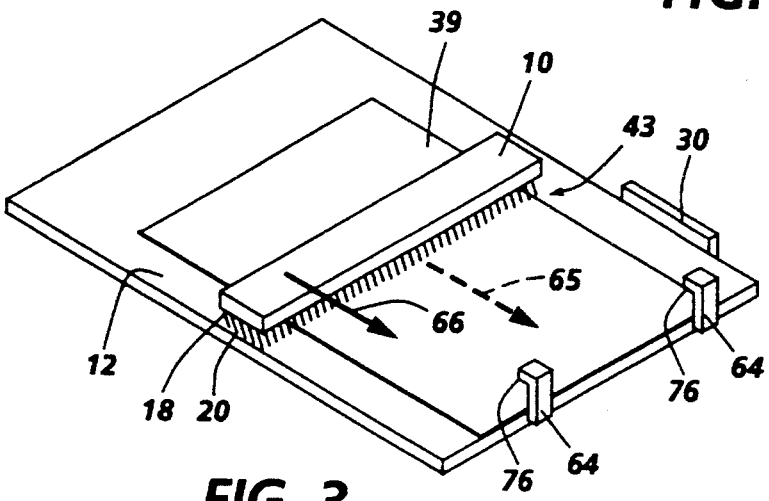

Thus, referring now to FIGS. 2, 3, 4, 5, and 6, the operation of the transport apparatus will be now discussed in greater detail. As seen in each of the FIGS. 2, 3, 4, 5 and 6, an elongated member 10 is shown with a brush-like material 18 secured thereto. It will be understood that suitable means for actuation the member 10 and supporting the member 10 are not shown in these illustrative figures, but are well known. Further, the fibers 20 of the brush-like material 18 are shown substantially oriented in the direction of arrow 14 with a slight deflection toward the lateral registration edge 30. In FIG. 2, the lead edge of sheet 39 has been moved, as indicated by arrow 65, through the sheet engaging area between the platen 12 and fibers 20 at the sheet receiving position 43 so that a substantially portion of the sheet extends both behind and ahead of the sheet engaging area. Movement of the elongated member 10 in the direction of arrow 66 is then commenced, as shown in FIG. 3, so that the fibers 20 urge the sheet in the direction of arrow 65 toward the front registration edge 64.

Figure 4:
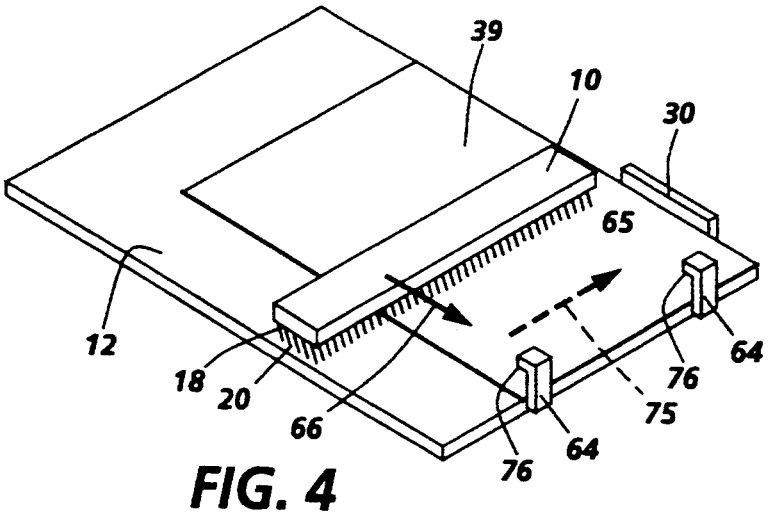
Figure 5:
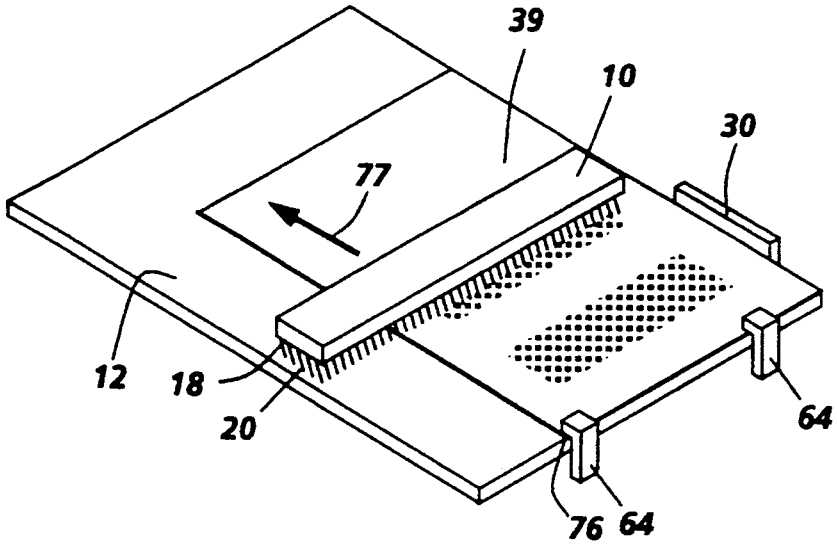
Figure 6:
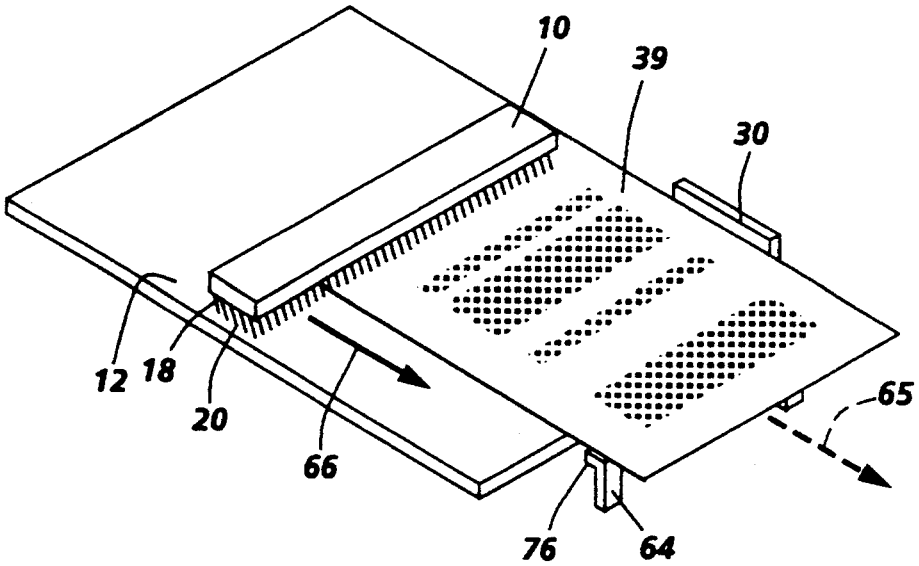

As shown in FIG. 4, the sheet 39 has reached the front registration edge 64 and has been registered thereat and the sheet 39 is now translated in the direction 75 toward the lateral registration edge 30 while the member 10 continues movement in the direction of arrow 66. In FIG. 5, the front registration edge 64 has been lowered so that the extended lip or flange 76 thereon holds the sheet 39 in position, on the platen 12, and the movement of the elongated members in the direction of arrow 77 and imaging (in this case: printing) of the sheet 39 by an imaging device (not shown) has commenced. Thus, as demonstrated by FIG. 5, the sheet 39 can be printed or otherwise operated on by a imaging device carried along with the elongated member 10. Further, as should be realized from FIG. 5, the movement of the fibers 20 across the sheet 39, when a sheet is clamped under flange 76, in the direction of arrow 77 tend to smooth and flatten the sheet 39 as the fibers 20 move over the sheet 39. It will be recognized that the provision of a smooth surface improves both the imageability and/or printability of a sheet on the platen 12. Finally, in FIG. 6, the sheet 39 is shown being pushed off the surface 12 by the forward movement of the member 10 in the direction of arrow 14. In this instance, the front registration edge 64 has been retracted below the platen 12 so that the sheet is no longer secured to the surface by the flange 76 and the registration edge 64 does not impede the forward translation of the sheet 39.

Figure 7:
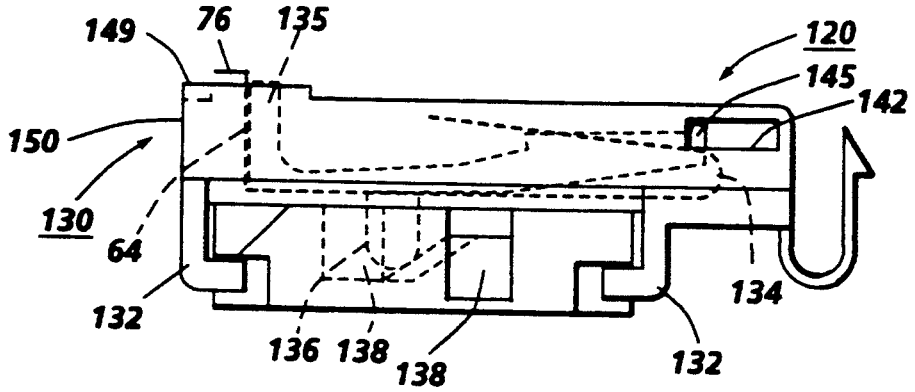
FIG. 7 is an enlarged elevational view of the front edge registering and clamping apparatus used in registering and clamping sheets transported by the sheet handling system of the device of FIGS. 1A and 1B.

Referring now to FIG. 7, a front registering device 120 is shown with the front registering edge 64 and the clamping flange 76. Further, the registering device 120 comprises a housing 130 which has extending portions 132 to engage and guide an actuating track 133. The actuating track 133, which is moved relative to the housing 130 by a suitably connected motor (not shown), is shown more clearly in FIG. 8. The registering edge 64 is part of a spring 134 mounted within the housing 130. Also mounted within the housing is a bracket 135 which is secured to the spring 134 so that the bracket 135 and the registration edge 64 is biased in a downward direction relative to the housing 130. The bracket 135 has a cam follower or a downward extending portion 136 which rides in a cam track 138 formed within the actuating track 133.

The bracket 135 is pivotally and slidably mounted by extending pins 145 in apertures 142 formed in the side of the housing 130. Thus, movement of the track 133 relative to the housing 130 causes the translation of the registration edge 64 relative to the housing 130. Movement of the actuating track 133, and consequently, the cam track 138 causes the movement of the bracket 135 in both a lateral and vertical direction. In this manner, the registration edge 64 can be moved from a first position for registering sheets to a second position for clamping sheets and finally a third position where the registration edge and clamp means are below the housing surface.

Figure 8:
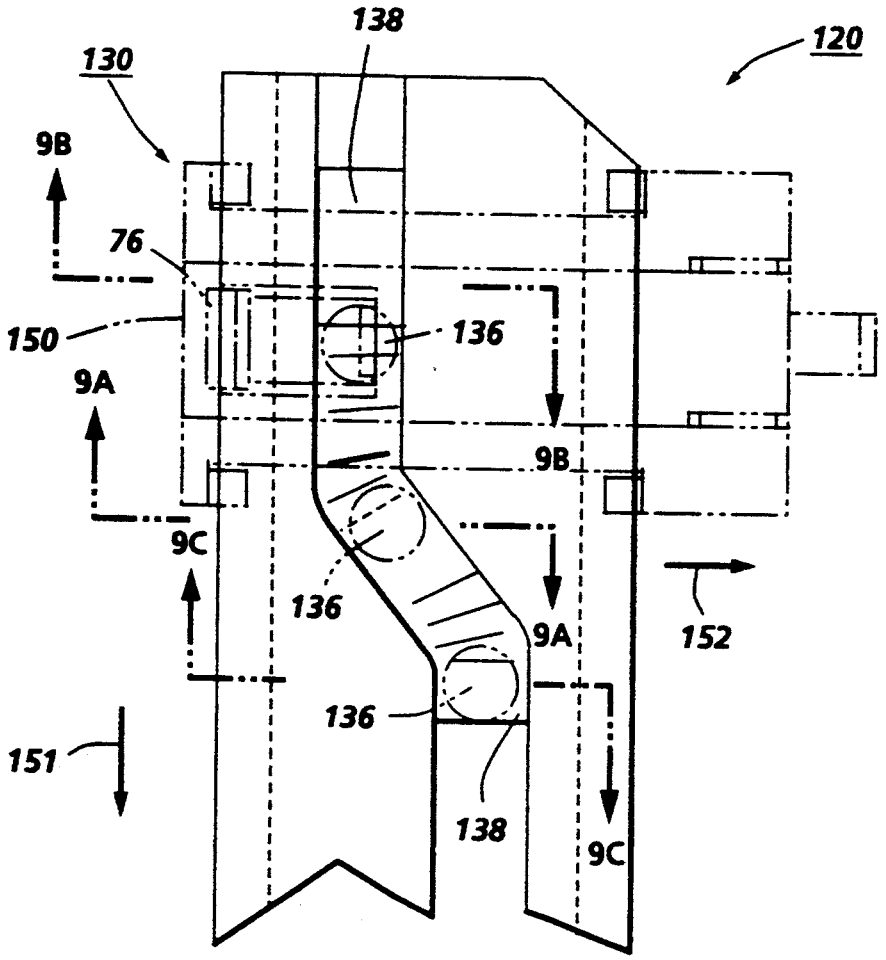
FIG. 8 is a plan view of the apparatus of FIG. 7 with portions shown in phantom lines to more clearly illustrate the actuating track of the registering and clamping apparatus.
Figure 9A:
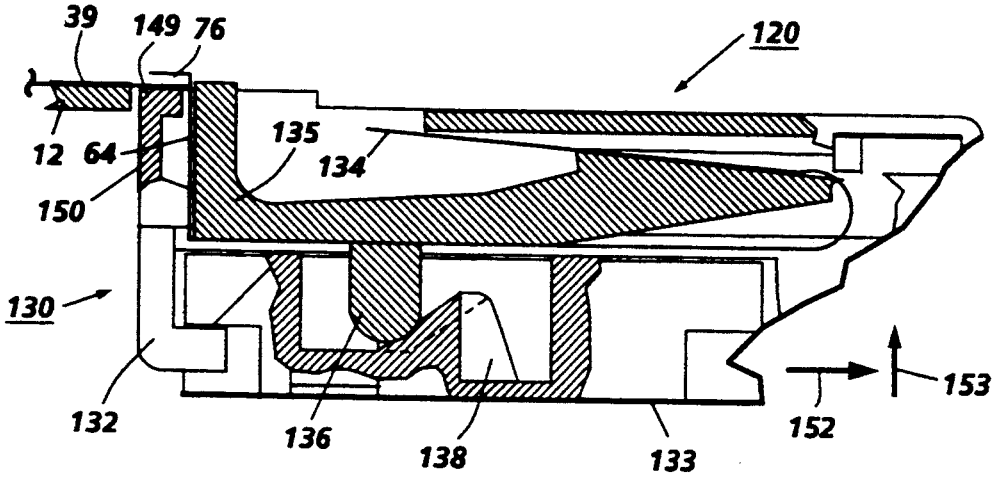
FIGS. 9A, 9B and 9C are fragmentary sectional views taken along the lines 9A—9A, 9B—9B and 9C—9C in the direction of the arrows of FIG. 8, respectively, to illustrate the operation of the registering and clamping apparatus.
Figure 9B:
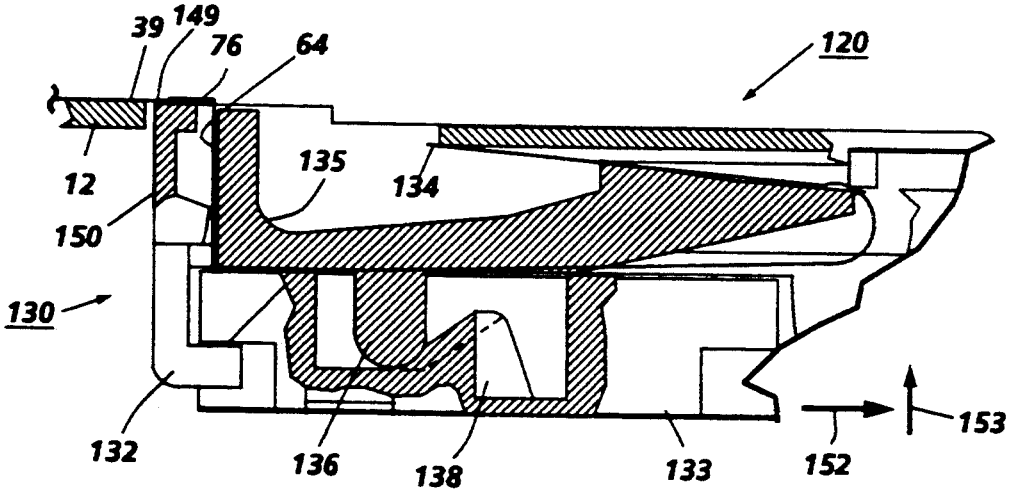
Figure 9C:
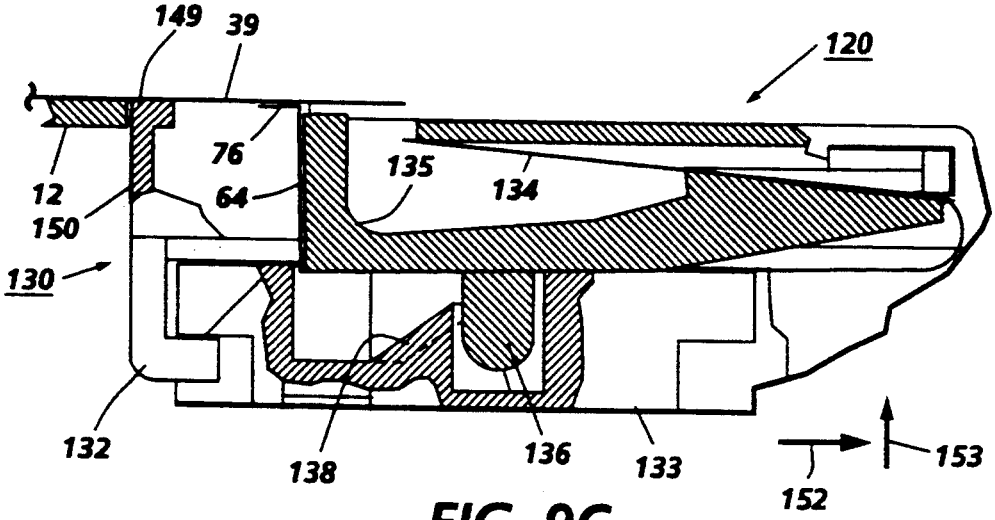

Referring now to FIGS. 9A, 9B and 9C, the housing 130, which is preferably fixed in a platen surface with the top lip 149 of the forward portion 150 of housing 130 flush with the platen surface 12, as shown. In FIG. 9B, the clamping flange 76 of the front registration edge 64 is shown in an operative position for clamping sheet 39 to the platen 12. As the track 133 is moved in the direction indicated by arrow 151 as shown in FIG. 8, the cam track 138 causes the downwardly extending portion 136 of the bracket 135 to be displaced laterally in the direction of arrow 152 and vertically in the direction of arrow 153 so that the registration edge 64 assumes the position shown in FIG. 9A with the extending portion 136 of the bracket 135 on a raised portion of the cam track 138. As the actuating track 133 is continued to be moved in the direction of 151, the downwardly extending portion 136 of the bracket 135 is continued to be displaced in the direction of arrow 152 but is now lowered in a direction opposite of arrow 153 so that the registration edge 64 and clamping flange 76 are lowered below the surface of the platen 12, as illustrated in FIG. 9C. Thus, in operation, as a sheet is moved toward the front registration edge 64, the front registration edge 64 is positioned, as shown in FIG. 9A, so that sheets transported across the surface 12 impact the vertical portion of the registration edge 64.

After the sheet has been registered but before any imaging activity, the clamping lip 76 of the registration edge 64 is lowered to secure the sheet to the platen 12 as shown in FIG. 9B by the actuation track 133. After the completion of imaging operations at the station, the registration edge is moved from the position shown in FIG. 9B through the position shown in FIG. 9A and to the position shown in FIG. 9C by the movement of the track 133 in the direction of arrow 151. In this manner, the sheet is released from the clamping flange 76 and the registration edge 64 is retracted below the surface of the platen 12 so that sheets may continue in the direction of entry to the platen surface and registration edge.

It should be recognized that many known front or process direction registration devices, useful in a manner similar to that described with respect to FIGS. 7, 8, 9A, 9B and 9C, can be used in conjunction with the sheet transport of the present invention. Further, it will also be understood and appreciated by those skilled in the art that the registration edge described in conjunction with the preferred embodiment of the present invention is preferred in the use of the invention, but is not essential to certain aspects of the invention.

In recapitulation, a sheet transport system has been disclosed in which a sheet is fed from a stack of sheets to a sheet receiving area. The sheet is supported by a platen surface and engaged by directionally oriented fibers. Movement of the fibers in a sheet transport direction tends to urge the transport of the sheets in a like direction. Further, the orientation of the fibers in a slightly lateral direction to the sheet transport provides a lateral registration force which urges transported sheets in both a lateral and sheet transport direction to permit registration of the transported sheets at an image processing station.

It is, therefore, apparent that there has been provided in accordance with the present invention, a sheet handling device or transport that fully satisfies the aims and advantages set forth herein. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A sheet transport for transporting sheets across a surface comprising:

a lateral registration member forming a side guide for sheets translated on the surface;

an elongated member including a multiplicity of fibers extending outwardly therefrom with said fibers forming a sheet receiving area with the surface;

means for moving said elongated member across the surface so as to translate a sheet in the sheet receiving area across the surface; said extending fibers are oriented substantially in the direction of sheet translation across the surface at an angle ranging from about 5° to about 12° in the direction of said lateral registration member; and clamping means for selectively and releasably securing sheets to the surface, said clamping means includes a lead edge registration member for engaging and registering a leading edge of sheets transported across the surface.

* * * * *